US010193212B2

(12) United States Patent
Lee et al.

(10) Patent No.: US 10,193,212 B2
(45) Date of Patent: Jan. 29, 2019

(54) DIGITAL TACHO GRAPH APPARATUS HAVING EMBEDDED RADIO FREQUENCY ANTENNA

(71) Applicants: HYUNDAI MOTOR COMPANY, Seoul (KR); YURA CORPORATION CO., LTD., Seongnam-si, Gyeonggi-do (KR)

(72) Inventors: Joo Wang Lee, Seoul (KR); Ki Taek Kang, Seongnam-si (KR)

(73) Assignees: Hyundai Motor Company, Seoul (KR); Yura Corporation Co., Ltd., Seongnam-si, Gyeonggi-do (KR)

( * ) Notice: Subject to any disclaimer, the term of this patent is extended or adjusted under 35 U.S.C. 154(b) by 175 days.

(21) Appl. No.: 15/343,379

(22) Filed: Nov. 4, 2016

(65) Prior Publication Data

US 2017/0338544 A1 Nov. 23, 2017

(30) Foreign Application Priority Data

May 18, 2016 (KR) ..... 10-2016-0060771

(51) Int. Cl.
*H01Q 1/22* (2006.01)
*H01Q 1/24* (2006.01)
(Continued)

(52) U.S. Cl.
CPC ..... *H01Q 1/2291* (2013.01); *H01Q 1/241* (2013.01); *H01Q 1/3291* (2013.01); *H01Q 1/38* (2013.01)

(58) Field of Classification Search
CPC ..... H01Q 1/2291; H01Q 1/214; H01Q 1/38
See application file for complete search history.

(56) References Cited

U.S. PATENT DOCUMENTS

2006/0170597 A1* 8/2006 Kurashima ..... H01Q 1/22 343/700 MS
2012/0188132 A1 7/2012 Peulecke et al.
(Continued)

FOREIGN PATENT DOCUMENTS

CN 204241737 U 4/2015
EP 2610816 A1 7/2013
(Continued)

OTHER PUBLICATIONS

Korean Office Action issued in corresponding Korean Patent Application No. 10-2016-0060771, dated Jul. 25, 2017.

*Primary Examiner* — Dameon E Levi
*Assistant Examiner* — David E Lotter
(74) *Attorney, Agent, or Firm* — McDermott Will & Emery LLP

(57) ABSTRACT

A digital tacho graph (DTG) apparatus for vehicles is disclosed. The DTG apparatus includes a metal terminal having one end connected to a printed circuit board (PCB) pattern unit connected to the wireless communication module, an RF antenna embedded inside the DTG apparatus and having one end connected to the other end of the metal terminal, and a front case unit, on which the other end of the RF antenna is formed by patterning, the front case unit serving as a front case of the DTG apparatus and enclosing the RF antenna inside the DTG apparatus. The wireless communication module and the embedded RF antenna are integrated, thereby reducing working time, increasing transmission and reception sensitivity, and reducing cost.

20 Claims, 3 Drawing Sheets

(51) Int. Cl.
*H01Q 1/38* (2006.01)
*H01Q 1/32* (2006.01)

(56) References Cited

U.S. PATENT DOCUMENTS

| | | | | |
|---|---|---|---|---|
| 2013/0127315 | A1* | 5/2013 | Wahler | B41J 29/13 312/249.7 |
| 2013/0249744 | A1* | 9/2013 | Jang | H01Q 21/30 343/702 |
| 2014/0018997 | A1* | 1/2014 | Sawhill | G07C 5/08 701/29.1 |

FOREIGN PATENT DOCUMENTS

| | | | |
|---|---|---|---|
| JP | 2000-307320 | A | 11/2000 |
| JP | 2003-324302 | A | 11/2003 |
| JP | 2009-119916 | A | 6/2009 |
| JP | 2011-228816 | A | 11/2011 |
| KR | 20-2013-0003684 | U | 6/2013 |
| KR | 10-2015-0028134 | A | 3/2015 |
| KR | 10-2015-0051975 | A | 5/2015 |

* cited by examiner

DIGITAL TACHO GRAPH APPARATUS HAVING EMBEDDED RADIO FREQUENCY ANTENNA

CROSS-REFERENCE TO RELATED APPLICATION

This application claims the benefit of Korean Patent Application No. 10-2016-0060771, filed on May 18, 2016, which is hereby incorporated by reference as if fully set forth herein.

TECHNICAL FIELD

The present disclosure relates to a digital tacho graph (DTG) apparatus for vehicles, and more particularly to a DTG apparatus having an optimally designed radio frequency (RF) antenna.

BACKGROUND

In recent years, examples of RF communication modules that support various types of wireless communication being provided to vehicles have been increasingly proposed.

For example, in order to transmit and receive telematics data, such as vehicle position data and navigation data, in a wireless fashion, a first DTG apparatus, having a global positioning system (GPS) communication module and a wideband code division multiple access (WCDMA) communication module, and an external RF antenna, connected to the GPS communication module and the WCDMA communication module via a connector, are installed in a vehicle.

Meanwhile, in order to support near field communication between a mobile terminal of a user in the vehicle and a second DTG apparatus, the second DTG apparatus, which has a near field communication module, and an in-vehicle RF antenna, connected to the second DTG apparatus via a connector, are installed in the vehicle.

The first DTG apparatus and the second DTG apparatus are installed in the vehicle in the state in which the first DTG apparatus and the second DTG apparatus are separate from each other.

In the case in which the DTG apparatuses are separately mounted in the vehicle, noise may increase due to interference between different wireless communication environments, with the result that the transmission and reception sensitivity of a wireless communication signal may be reduced.

Furthermore, in the case in which a plurality of external RF antennas and in-vehicle RF antennas are installed inside and outside the vehicle, the number of connection structures between the respective RF antennas and communication modules corresponding thereto is increased, whereby design cost and time may be increased.

SUMMARY

Accordingly, the present disclosure is directed to a DTG apparatus that substantially obviates one or more problems due to limitations and disadvantages of the related art.

An object of the present disclosure is to provide a DTG apparatus configured such that communication parts necessary to transmit and receive different RF signals are integrated.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a digital tacho graph (DTG) apparatus for transmitting and receiving one or more different radio frequency (RF) signals through a wireless communication module and an RF antenna includes a metal terminal having one end connected to a printed circuit board (PCB) pattern unit connected to the wireless communication module, the RF antenna embedded inside the DTG apparatus and having one end connected to the other end of the metal terminal, and a front case unit, on which the other end of the RF antenna is formed by patterning, the front case unit serving as a front case of the DTG apparatus and enclosing the RF antenna inside the DTG apparatus.

The RF antenna may be patterned on the inside of front case unit using one selected from between laser direct structuring (LDS) and printing direct structuring (PDS).

The one end of the metal terminal may be connected to the PCB pattern unit by soldering.

The metal terminal may be made of a copper alloy.

The metal terminal may have a double bent structure comprising a first bent structure and a second bent structure, the first bent structure being connected to the PCB pattern unit and the second bent structure being connected to the RF antenna.

The DTG apparatus may further include a body case unit coupled with the front case unit such that the wireless communication module, the metal terminal, and the RF antenna are disposed in a space defined by the body case unit and the front case unit.

The front case unit may include a rotation part having one end coupled to a rotation center shaft provided at the body case unit so as to be rotated about the rotation center shaft and a front case coupled to the other end of the rotation part so as to be tilted upward and downward by rotation of the rotation part.

The rotation part may be inserted into a rotation recess provided in the body case unit so as to be rotated about the rotation center shaft.

The front case unit may further include a protection cover covering a contact region between the rotation part and the front case, the protection cover being formed on one surface of the front case.

In another aspect of the present disclosure, a DTG apparatus for transmitting and receiving one or more different RF signals through a wireless communication module and an RF antenna, which are integrated, includes to the wireless communication module mounted on a PCB, the RF antenna embedded inside the DTG apparatus, spaced apart from the PCB, and electrically connected to the PCB through a PCB pattern unit on the PCB and a metal terminal, a front case unit, on the inside of which the other end of the RF antenna is formed by patterning, the front case unit serving as a front case of the DTG apparatus, and a body case unit coupled with one side of the front case unit such that the wireless communication module, the metal terminal, and the RF antenna are disposed in a space defined by the body case unit and the front case unit.

The RF antenna may be patterned on the inside of front case unit using one selected from between LDS and PDS.

The one end of the metal terminal may be connected to the PCB pattern unit by soldering.

The metal terminal may be made of a copper alloy.

The metal terminal may have a double bent structure comprising a first bent structure and a second bent structure, the first bent structure being connected to the PCB pattern unit and the second bent structure being connected to the RF antenna.

The front case unit may include a rotation part having one end coupled to a rotation center shaft provided at the body case unit so as to be rotated about the rotation center shaft and a front case coupled to the other end of the rotation part so as to be tilted upward and downward by rotation of the rotation part.

The rotation part may be inserted into a rotation recess provided in the body case unit so as to be rotated about the rotation center shaft.

The front case unit may further include a protection cover covering a contact region between the rotation part and the front case, the protection cover being formed on one surface of the front case.

In a further aspect of the present disclosure, a DTG apparatus for transmitting and receiving one or more different RF signals through a wireless communication module and an RF antenna, which are integrated, includes a metal terminal having one end connected to a PCB pattern unit connected to the wireless communication module, an embedded RF antenna having one end connected to the other end of the metal terminal, a front case unit, on the inside of which the RF antenna is mounted, the RF antenna being patterned using one selected from between LDS and PDS.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Figure 1:
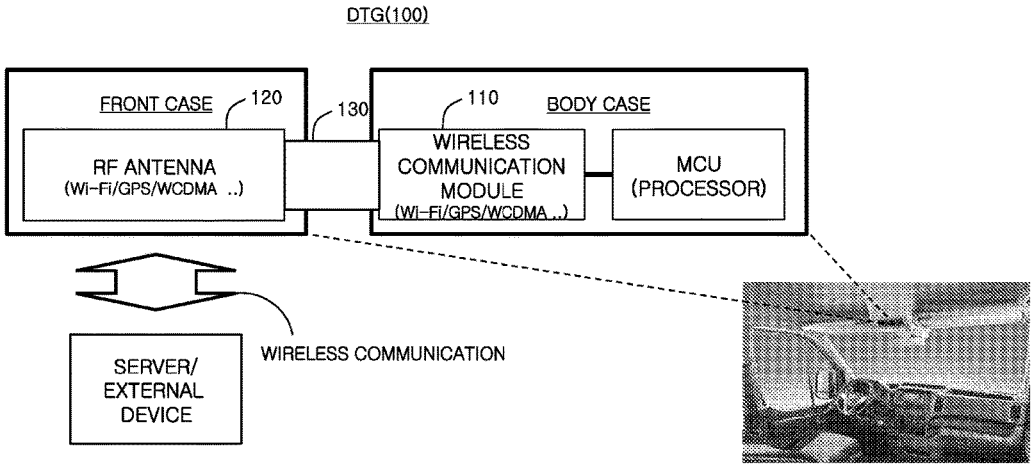
FIG. 1 is a block diagram exemplarily and schematically showing an example of a DTG apparatus according to an embodiment of the present disclosure.

Hereinafter, reference will now be made in detail to the preferred embodiments of the present disclosure, examples of which are illustrated in the accompanying drawings. In the drawings, the same or similar elements are denoted by the same reference numerals even though they are depicted in different drawings, and a detailed description of the same or similar elements will be omitted.

In addition, the accompanying drawings have been made only for a better understanding of the embodiments disclosed herein and are not intended to limit technical ideas disclosed herein, and it should be understood that the accompanying drawings are intended to encompass all modifications, equivalents, and substitutions included in the spirit and scope of the present disclosure.

Meanwhile, terms including ordinal expressions, such as "first" and "second," are used in this specification to describe various elements. However, the elements are not limited by the terms, and the terms are used only to distinguish between the elements.

In addition, in the following description of the embodiments disclosed herein, a detailed description of related known technologies will be omitted when it may make the subject matter of the embodiments disclosed herein rather unclear.

<Example of DTG Apparatus>

FIG. 1 is a block diagram exemplarily and schematically showing an example of a DTG apparatus according to an embodiment of the present disclosure.

Referring to FIG. 1, a DTG apparatus 100 according to an embodiment of the present disclosure is installed in a vehicle to transmit and receive one or more different RF signals through a wireless communication module 110 and an RF antenna 120.

In other words, the DTG apparatus 100 may include a wireless communication module 110 and an RF antenna 120, which are integrated. Consequently, the DTG apparatus 100 may transmit and receive one or more different RF signals through the wireless communication module 110 and the RF antenna 120, which are integrated.

The wireless communication module 110 may be a module that transmits and receives a communication signal related to at least one selected from among a cellular network (for example, Global System for Mobile Communications (GSM), Enhanced Data Rates for GSM Evolution (EDGE), General Packet Radio Service (GPRS), Code Division Multiple Access (CDMA), Time Division-CDMA (TD-CDMA), Universal Mobile Telecommunications System (UMTS), Long Term Evolution (LTE), or another cellular network), short-range communication (for example, Wireless LAN, Wi-Fi, Bluetooth, ZigBee, Wi-Fi Direct (WFD), Ultra Wideband (UWB), Infrared Data Association (IrDA), Bluetooth Low Energy (BLE), Near Field Communication (NFC)), satellite communication, and Global Positioning System (GPS) communication.

For example, the wireless communication module 110 may transmit and receive a Wi-Fi (2.4 GHz) signal, a GPS (1.5 GHz) signal, and a WCDMA (1.8 GHz or 2.1 GHz) signal through the wireless communication module 110 and the RF antenna 120, which are integrated.

The wireless communication module 110 and the RF antenna 120 may be integrated via a metal terminal 130. That is, the metal terminal 130 may be provided between the wireless communication module 110 and the RF antenna 120.

Hereinafter, the structure in which the wireless communication module 110 and the RF antenna 120 are integrated will be described in more detail.

Figure 2:
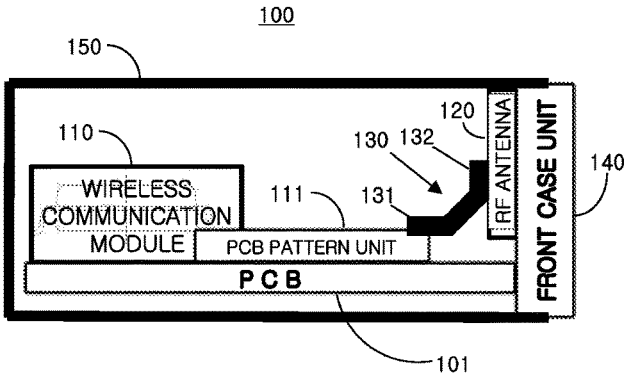
FIG. 2 is a side view exemplarily showing the structure of the DTG apparatus shown in FIG. 1.
Figure 3:
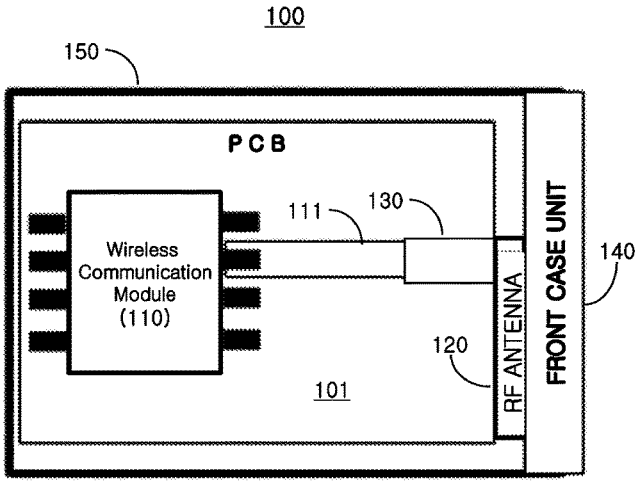
FIG. 3 is a front view exemplarily showing the structure of the DTG apparatus shown in FIG. 1.

FIG. 2 is a side view exemplarily showing the structure of the DTG apparatus shown in FIG. 1, and FIG. 3 is a front view exemplarily showing the structure of the DTG apparatus shown in FIG. 1.

As shown, the DTG apparatus 100 may include a wireless communication module 110, a metal terminal 130, an RF antenna 120, a front case unit 140, and a body case unit 150.

The wireless communication module 110 may transmit and receive a Wi-Fi (2.4 GHz) signal, a GPS (1.5 GHz) signal, and a WCDMA (1.8 GHz or 2.1 GHz) signal to and from a server (not shown) to acquire wireless data.

The acquired wireless data may be processed by a processor (controller) provided in the DTG apparatus 100, or may be transmitted to another display device (not shown) separate from the DTG apparatus 100 such that the acquired wireless data are processed by a processor (controller) of the display device.

The display device may include an audio video navigation (AVN) terminal having an audio function, a video function, and a navigation function, a navigation terminal having only a navigation function, and a cluster for displaying the velocity and fuel consumption of a vehicle. However, the present disclosure is not limited thereto. The display device may be an electronic device or a communication device having functions different from the above-mentioned functions.

One end of the metal terminal 130 may be connected to a printed circuit board (PCB) pattern unit 111, which is connected to the wireless communication module 110. The connection between the metal terminal 130 and the PCB pattern unit 111 may be achieved by soldering one end of the metal terminal 130 to the PCB pattern unit 111 and/or a PCB 101.

On the other hand, the other end of the metal terminal 130 is connected to the RF antenna 120. More specifically, the metal terminal 130 may have a double bent structure including a first bent structure 131 and a second bent structure 132. In this case, the first bent structure 131 may be connected to the PCB pattern unit 111, and the second bent structure 132 may be connected to the RF antenna 120.

The connection between the PCB pattern unit 111 and the metal terminal 130 and between the metal terminal 130 and the RF antenna 120 may be achieved using various well-known methods, a description of which will be omitted, in addition to soldering.

The metal terminal 130 may be made of a copper alloy in order to achieve smooth RF signal transmission and reception between the wireless communication module 110 and the RF antenna 120, which will be described hereinafter. For example, the metal terminal 130 may be made of a copper alloy, such as SUS 304 or SUS 301.

As described above, one end of the RF antenna 120 may be connected to the other end of the metal terminal 130, and the other end of the RF antenna 120 may be connected to the front case unit 140, which will be described hereinafter.

The RF antenna 120 is formed on the front case unit 140 and inside a space enclosed by the front case unit 140 and the body case unit 150, with the result that the RF antenna 120 is mounted in the DTG apparatus 100. For this reason, the RF antenna 120 may be referred to as an embedded antenna.

Conventionally, most DTG apparatuses each include an in-vehicle RF antenna and/or an external RF antenna. In this embodiment, however, the embedded RF antenna 120 is used in the DTG apparatus 100 instead of the in-vehicle RF antenna and/or the external RF antenna.

Internally, the embedded RF antenna 120 is electrically connected to the wireless communication module 110 via the metal terminal 130. Externally, the embedded RF antenna 120 is connected to various external devices (for example, a server, an external communication device, and a wireless terminal) to transmit and receive various RF signals, such as a Wi-Fi (2.4 GHz) signal, a GPS (1.5 GHz) signal, and a WCDMA (1.8 GHz or 2.1 GHz) signal, to and from the external devices.

Alternatively, the embedded RF antenna 120 may be configured to transmit and receive a single specific RF signal, rather than various RF signals.

For example, in the case in which a plurality of DTG apparatuses 100 is provided, each DTG apparatus 100 may include an embedded RF antenna 120 configured to transmit and receive a specific RF signal.

The front case unit 140 serves as a front case of the DTG apparatus 100. To this end, the front case unit 140 may be coupled to the body case unit 150. The RF antenna 120 may be located in a space defined by the front case unit 140 and the body case unit 150.

To this end, the other end of the RF antenna 120 is patterned on the front case unit 140 and is located in the space defined by the front case unit 140 and the body case unit 150.

The RF antenna 120 may be patterned using laser direct structuring (LDS) or printing direct structuring (PDS).

That is, the RF antenna 120 may be patterned on the front case unit 140 and in the space enclosed by the front case unit 140 and the body case unit 150 using LDS or PDS.

LDS and PDS are well-known patterning methods, which are used to design the internal structure of the RF antenna. In this embodiment, LDS or PDS is used to pattern the RF antenna 120 on the front case unit 140 and in the space enclosed by the front case unit 140 and the body case unit 150.

Alternatively, the RF antenna 120 may not be patterned on the front case unit 140, but may be configured so as to be separate from the front case unit 140.

For example, in the case in which the front case unit 140 is tilted upward or downward, the RF antenna 120 located on the front case unit 140 may also move. In this case, the metal terminal 130 may be flexible.

However, in the structure in which the RF antenna 120 is separate from the front case unit 140, the RF antenna 120 may not be affected by upward and downward tilting of the front case unit 140.

The body case unit 150 may be coupled to the front cover unit 140 such that the communication module 110, the metal terminal 130, and the RF antenna 120 may be mounted in the space defined by the body case unit 150 and the front cover unit 140.

The PCB 101 may be formed under the communication module 110, the metal terminal 130, and the RF antenna 120. The PCB 101 may directly contact the communication module 110/the metal terminal 130. However, the PCB 101 may not directly contact the RF antenna 120. Specifically, the RF antenna 120 may be located above the PCB 101.

Hereinafter, a coupling structure between the front case unit and the body case unit will be described in more detail.

Figure 4:
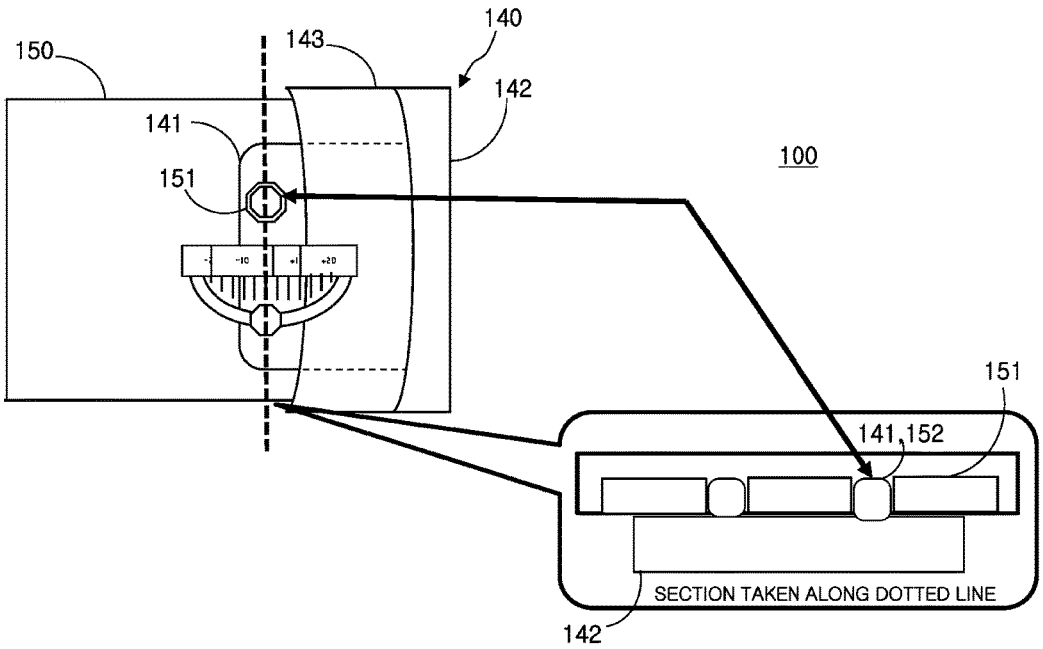
FIG. 4 is a sectional view exemplarily showing a coupling structure between a front case unit and a body case unit according to an embodiment of the present disclosure.
Figure 5:
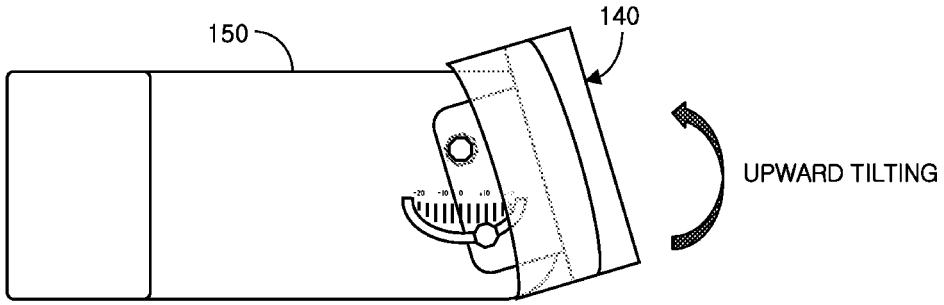
FIGS. 5 and 6 are sectional views exemplarily showing tilt states of the front case unit shown in FIG. 4.
Figure 6:
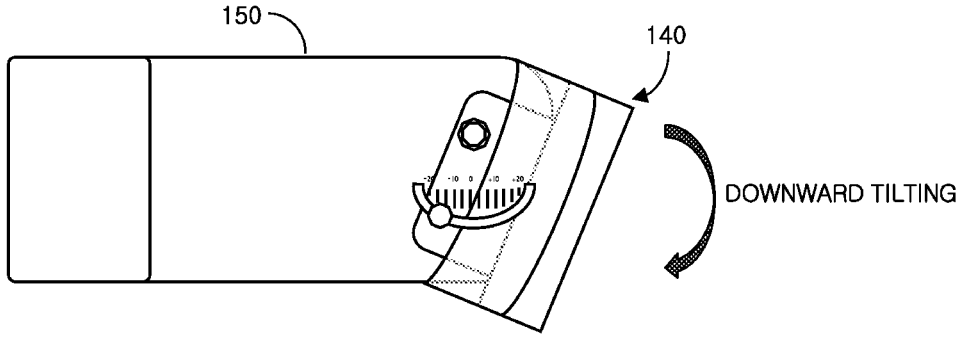

FIG. 4 is a sectional view exemplarily showing the coupling structure between the front case unit and the body case unit, and FIGS. 5 and 6 are sectional views exemplarily showing tilt states of the front case unit shown in FIG. 4.

As shown, the front case unit 140, which is coupled to the body case unit 150, may be tilted upward and downward. To this end, the front case unit 140 may include a rotation part 141, a front case 142, and a protection cover 143.

One end of the rotation part 141 is coupled to a rotation center shaft 151 provided at the body case unit 150 such that the rotation part 141 can be rotated about the rotation center shaft 151. The body case unit 150 may be provided with at least one rotation recess 152, which is located adjacent to the rotation center shaft 151.

Consequently, the rotation part 141 may protrude toward the body case unit 150. The protruding rotation part 141 may be inserted into the rotation recess 152 and, at the same time, into the rotation center shaft 151 formed in the rotation recess 152, whereby the rotation part 141 may be tilted upward and downward from the rotation center shaft 151.

The front case 142 may be coupled to the other end of the rotation part 141 so as to substantially form the front shape of the DTG apparatus 100. In addition, the front case 142 may be tilted upward and downward by the rotation of the rotation part 141.

The front case 142 may have a height greater than the vertical height of the rotation part 141, and may have approximately the same height as the body case unit 150.

The protection cover 143 may cover a contact portion between the rotation part 141 and the front case 142. The protection cover 143 may be formed on one surface of the front case 142 that faces the body case unit 150.

When the front case 142, coupled to the rotation part 141, is tilted upward and downward, therefore, the protection cover 143 covers the gap between the body case unit 150 and the front case unit 140, thereby preventing foreign matter, such as dust, from being introduced into the DTG apparatus 100.

However, the above structure of the protection cover 143 is merely an example. The protection cover 143 may have various other flexible structures as long as the protection cover 143 prevents the introduction of foreign matter into the DTG apparatus 100 when the front case 142 is tilted upward and downward.

The front case 142, coupled to the rotation part 141, is tilted upward and downward in order to transmit and receive an RF signals having high transmission and reception sensitivity. The upward and downward tilting of the front case 142 may be performed by an operator, or may be automatically performed.

As is apparent from the above description, in the DTG apparatus according to the present disclosure, the embedded RF antenna is formed on the front case unit and in the space enclosed by the front case unit and the body case unit, and the embedded RF antenna is connected to the metal terminal. Consequently, a wire harness, which may be required when an external antenna is mounted, may be obviated, thereby reducing working time, increasing transmission and reception sensitivity, and reducing cost.

In addition, when in-line and field work is performed through the wireless communication module and the RF antenna, which are integrated, or when at least one of the wireless communication module and the RF antenna is replaced, human labor may be reduced.

It will be appreciated by persons skilled in the art that that the effects that can be achieved through the present disclosure are not limited to what has been particularly described hereinabove and other advantages of the present disclosure will be more clearly understood from the above detailed description.

It will be apparent to those skilled in the art that various modifications and variations can be made in the present disclosure without departing from the spirit or scope of the disclosure. Thus, it is intended that the present disclosure covers the modifications and variations of this disclosure provided they come within the scope of the appended claims and their equivalents.

What is claimed is:

1. A digital tacho graph (DTG) apparatus for transmitting and receiving one or more different radio frequency (RF) signals through a wireless communication module and an RF antenna, the DTG apparatus comprising: a metal terminal having one end connected to a printed circuit board (PCB) pattern unit connected to the wireless communication module; the RF antenna, embedded inside the DTG apparatus, having one end connected to the other end of the metal terminal; and a front case unit, on which the other end of the RF antenna is formed by patterning, the front case unit serving as a front case of the DTG apparatus and enclosing the RF antenna inside the DTG apparatus wherein a PCB, on which the PCB pattern unit is formed, is disposed under the wireless communication module, the metal terminal, and the RF antenna, and the PCB pattern unit directly contacts the wireless communication module and the metal terminal, and is spaced apart from the RF antenna.

2. The DTG apparatus according to claim 1, wherein the RF antenna is patterned on the front case unit using one selected from laser direct structuring (LDS) and printing direct structuring (PDS).

3. The DTG apparatus according to claim 1, wherein the one end of the metal terminal is connected to the PCB pattern unit by soldering.

4. The DTG apparatus according to claim 1, wherein the metal terminal is made of a copper alloy.

5. The DTG apparatus according to claim 1, wherein the metal terminal has a double bent structure comprising a first bent structure and a second bent structure, the first bent structure being connected to the PCB pattern unit and the second bent structure being connected to the RF antenna.

6. The DTG apparatus according to claim 1, further comprising a body case unit coupled with the front case unit such that the wireless communication module, the metal terminal, and the RF antenna are disposed in a space defined by the body case unit and the front case unit.

7. The DTG apparatus according to claim 6, wherein the front case unit comprises:

a rotation part having one end coupled to a rotation center shaft provided at the body case unit so as to be rotated about the rotation center shaft; and a front case coupled to the other end of the rotation part so as to be tilted upward and downward by rotation of the rotation part.

8. The DTG apparatus according to claim 7, wherein the rotation part is inserted into a rotation recess provided in the body case unit so as to be rotated about the rotation center shaft.

9. The DTG apparatus according to claim 7, wherein the front case unit further comprises a protection cover covering a contact region between the rotation part and the front case, the protection cover being formed on one surface of the front case.

10. A digital tacho graph (DTG) apparatus for transmitting and receiving one or more different radio frequency (RF) signals through a wireless communication module and an RF antenna, the DTG apparatus comprising:

the wireless communication module mounted on a printed circuit board (PCB);

the RF antenna, embedded inside the DTG apparatus, spaced apart from the PCB, and electrically connected to a PCB pattern unit on the PCB through a metal terminal;

a front case unit, on which the other end of the RF antenna is formed by patterning, the front case unit serving as a front case of the DTG apparatus; and a body case unit coupled with one side of the front case unit such that the wireless communication module, the metal terminal, and the RF antenna are disposed in a space defined by the body case unit and the front case unit, wherein the PCB is disposed under the wireless communication module, the metal terminal, and the RF antenna, and the PCB pattern unit directly contacts the wireless communication module and the metal terminal.

11. The DTG apparatus according to claim 10, wherein the RF antenna is patterned on the inside of the front case unit using one selected from laser direct structuring (LDS) and printing direct structuring (PDS).

12. The DTG apparatus according to claim 10, wherein the one end of the metal terminal is connected to the PCB pattern unit by soldering.

13. The DTG apparatus according to claim 10, wherein the metal terminal is made of a copper alloy.

14. The DTG apparatus according to claim 10, wherein the metal terminal has a double bent structure comprising a first bent structure and a second bent structure, the first bent structure being connected to the PCB pattern unit and the second bent structure being connected to the RF antenna.

15. The DTG apparatus according to claim 10, wherein the front case unit comprises:

a rotation part having one end coupled to a rotation center shaft provided at the body case unit so as to be rotated about the rotation center shaft; and a front case coupled to the other end of the rotation part so as to be tilted upward and downward by rotation of the rotation part.

16. The DTG apparatus according to claim 15, wherein the rotation part is inserted into a rotation recess provided in the body case unit so as to be rotated about the rotation center shaft.

17. The DTG apparatus according to claim 15, wherein the front case unit further comprises a protection cover covering a contact region between the rotation part and the front case, the protection cover being formed on one surface of the front case.

18. A digital tacho graph (DTG) apparatus for transmitting and receiving one or more different radio frequency (RF) signals through a wireless communication module and an RF antenna, the DTG apparatus comprising:

a metal terminal having one end connected to a printed circuit board (PCB) pattern unit connected to the wireless communication module;

the RF antenna, embedded inside the DTG apparatus, having one end connected to the other end of the metal terminal;

a front case unit, on which the RF antenna is mounted, enclosing the RF antenna inside the DTG apparatus, the RF antenna being patterned using one selected from laser direct structuring (LDS) and printing direct structuring (PDS), wherein a PCB, on which the PCT pattern unit is formed, is disposed under the wireless communication module, the metal terminal, and the RF antenna, and the PCB pattern unit directly contacts the wireless communication module and the metal terminal and is spaced apart from the RF antenna.

19. The DTG apparatus according to claim 10, wherein the PCB is disposed on a first interior surface of the body, and the RF antenna extends on a surface of the front case unit connecting the first interior surface of the body to a second interior surface of the body opposing the first interior surface of the body.

20. The DTG apparatus according to claim 6, wherein the PCB is disposed on a first interior surface of the body, and the RF antenna is disposed on a surface of the front case unit connecting the first interior surface of the body to a second interior surface of the body opposing the first interior surface of the body.

* * * * *